US009327889B2

(12) United States Patent
Barkerding et al.

(10) Patent No.: US 9,327,889 B2
(45) Date of Patent: May 3, 2016

(54) BEVERAGE CARRIER WITH DETACHABLE SLEEVES AND METHOD FOR MAKING THE SAME

(71) Applicant: SMARTPAK, LLC, New Orleans, LA (US)

(72) Inventors: T. Pike Barkerding, New Orleans, LA (US); Robert Henry Post, Covington, LA (US)

(73) Assignee: SmartPak, LLC, New Orleans, LA (US)

( * ) Notice: Subject to any disclaimer, the term of this patent is extended or adjusted under 35 U.S.C. 154(b) by 0 days.

(21) Appl. No.: 14/583,387

(22) Filed: Dec. 26, 2014

(65) Prior Publication Data

US 2015/0183562 A1 Jul. 2, 2015

Related U.S. Application Data

(60) Provisional application No. 61/921,404, filed on Dec. 27, 2013.

(51) Int. Cl.

| | |
|---|---|
| ***B65D 75/00*** | (2006.01) |
| ***B65D 71/40*** | (2006.01) |
| ***B31B 3/00*** | (2006.01) |
| ***B65D 71/12*** | (2006.01) |
| ***B65D 81/38*** | (2006.01) |
| *B65B 3/00* | (2006.01) |

(52) U.S. Cl.

CPC ..... *B65D 71/406* (2013.01); *B31B 3/00* (2013.01); *B65D 71/125* (2013.01); *B65D 81/3876* (2013.01); *B65B 3/00* (2013.01); *B65D 2571/0066* (2013.01); *B65D 2571/00141* (2013.01); *B65D 2571/00475* (2013.01); *B65D 2571/00802* (2013.01)

(58) Field of Classification Search

CPC .... B65D 71/125; B65D 71/406; B65D 71/52; B65D 81/376; B65D 2571/00141; B65D 2571/00475; B65D 2571/0066; B65D 2571/00802; B65B 3/00

USPC ..... 206/141, 143, 144, 150, 151, 427

See application file for complete search history.

(56) References Cited

U.S. PATENT DOCUMENTS

| | | | |
|---|---|---|---|
| 2,284,290 | A | 5/1942 | Crook |
| 2,630,264 | A | 3/1953 | Holy |
| 2,888,164 | A | 5/1959 | Corwin |
| 2,998,899 | A | 9/1961 | Telesca |
| 3,359,873 | A | 12/1967 | Carle et al. |
| 3,386,607 | A | 6/1968 | Keene |

(Continued)

FOREIGN PATENT DOCUMENTS

KR 10-20130048030 * 9/2013 ..... B65D 71/44

*Primary Examiner* — Bryon Gehman

(74) *Attorney, Agent, or Firm* — AdamsIP, LLC; J. Hunter Adams; Stephen Thompson

(57) ABSTRACT

The present invention provides a beverage carrier for holding, storing, and carrying one or more beverages. Advantageously, the carrier comprises detachable sleeves that each hold a beverage container. When a sleeve is detached from the remainder of the beverage carrier, with the beverage remaining within the sleeve, the sleeve serves as an insulating device to reduce the transfer of heat to or from the beverage during consumption.

23 Claims, 15 Drawing Sheets

(56) References Cited

U.S. PATENT DOCUMENTS

| | | | | | |
|---|---|---|---|---|---|
| 3,498,523 | A | | 3/1970 | Lambert | |
| 3,596,796 | A | | 8/1971 | Stembridge | |
| 3,751,098 | A | | 8/1973 | Owen | |
| 3,759,373 | A | | 9/1973 | Werth et al. | |
| 3,908,523 | A | * | 9/1975 | Shikaya | B65D 3/22 229/90 |
| 3,948,388 | A | * | 4/1976 | Mueller | B65D 71/40 206/192 |
| 4,940,137 | A | | 7/1990 | Straub | |
| D320,158 | S | | 9/1991 | Contino | |
| 6,026,983 | A | | 2/2000 | Graham | |
| D427,522 | S | | 7/2000 | Ponzio | |
| 6,412,686 | B1 | | 7/2002 | Mahl et al. | |
| 7,311,201 | B2 | * | 12/2007 | Lo | B65D 15/04 206/427 |
| 7,815,047 | B2 | | 10/2010 | Trimarco | |
| 7,832,553 | B2 | * | 11/2010 | Hartness | B65D 71/08 206/150 |
| 7,850,003 | B2 | * | 12/2010 | Hartness | B65D 71/08 206/150 |
| 2006/0102497 | A1 | | 5/2006 | Wulf | |
| 2009/0090642 | A1 | | 4/2009 | Trimarco | |
| 2009/0090732 | A1 | | 4/2009 | Trimarco | |
| 2009/0205111 | A1 | | 8/2009 | Beard | |
| 2009/0294317 | A1 | | 12/2009 | Villhard | |
| 2014/0038804 | A1 | | 2/2014 | Konkin | |

* cited by examiner

BEVERAGE CARRIER WITH DETACHABLE SLEEVES AND METHOD FOR MAKING THE SAME

CROSS REFERENCES

This application claims the benefit of U.S. Provisional Application No. 61/921,404, filed on Dec. 27, 2013, which application is incorporated herein by reference.

BACKGROUND OF THE INVENTION

I. Field of the Invention

The present invention relates to beverage carriers, and more specifically to beverage carriers comprising detachable insulating sleeves and the method of making said beverage carriers.

II. Description of Related Art

Beverage carriers are used, generally, to hold and transport one or more beverage containers. Commonly, beverage carriers are used to hold six individual glass bottles (i.e., a six-pack) so that they can be stored and transported easily. These six-pack carriers are generally made of cardboard or paperboard, and are assembled using automated systems capable of cutting, folding and gluing the beverage carriers.

When a user desires to open and drink the beverages contained within the carrier, the user generally lifts the beverages out of the carrier and subsequently discards the carrier once all individual beverages are removed. The user may then desire to keep his or her beverage insulated from external heat sources, such as heat from the environment or heat from the user's hand, during consumption by inserting the beverage into an insulating device (for example, a Koozie®, huggie, can coolers, etc.). However, the user may often find himself or herself without a can cooler, and, thus, unable to easily insulate his or her beverage.

A beverage carrier that comprises sleeves that retain their structure after detachment from the carrier, that serve to insulate the beverage from external heat sources such as heat from the environment or heat from the user's hand during consumption (and, thus, eliminating the need to utilize a separate koozie), and that further can be simply assembled using automated machinery and materials commonly used in the industry, is clearly needed.

BRIEF SUMMARY OF THE INVENTION

One aspect of the present invention provides for a beverage carrier for carrying one or more individual beverage containers. The beverage carrier is comprised of a handle and one or more individual sleeves wherein each of the sleeves is configured such that each sleeve can be individually detached from the handle and remain structurally intact. When carrying one or more beverages, each sleeve surrounds one beverage container. Thus, a user of the device can detach a sleeve containing a beverage container, such as a bottle or can filled with a beverage, and drink the beverage with the sleeve surrounding the beverage container. The sleeve insulates the beverage from external heat sources, such as heat from the environment or heat from the user's hand. Conversely, the sleeve also protects the user's hand from becoming too cold when holding a cold beverage container. Additionally, although the device is typically used to insulate cold beverages, it may also be used in the same manner to insulate hot beverages.

Another aspect of the present invention provides for a beverage carrier comprising a handle and one or more sleeves, wherein each of the sleeves is attached to the handle along a perforated attachment surface. Each sleeve can then be detached from the handle simply by tearing the sleeve away from the handle along the perforated attachment surface. Each perforated attachment surface is configured in a generally vertical position such that the perforations extend vertically along the exterior of each respective sleeve when the assembled beverage carrier is in an upright position resting on the bottoms of the sleeves. Thus, each sleeve is attached to the handle along a generally straight and generally vertical perforated attachment surface rather than a curved attachment surface extending horizontally around the circular perimeter of the sleeve.

In an additional embodiment, the present invention provides for a beverage carrier comprising a handle having one or more windows disposed within the handle, and one or more sleeves wherein each of the sleeves comprises an attachment skirt. When the sleeves are attached to the handle, each of the respective attachment skirts rests within a respective one of said windows. Thus, the user can remove a sleeve containing a beverage container simply by lifting the sleeve away from the handle such that the skirt is lifted out of the window.

Another aspect of the present invention provides a method of assembling a beverage carrier from a single piece of material. The single piece of material is substantially flat and can be assembled into a beverage carrier using automated machinery commonly used in the industry. The material has a shape comprising a handle having two opposing edges and at least one panel attached to each edge of the handle along an attachment surface. Each panel has two opposing ends. Perforations are made along each attachment surface connecting the handle with each of the panels. Next, three-dimensional sleeves are formed by attaching the opposing ends of each panel to each other. The handle is then folded in half such that each of the sleeves attached to one edge of the handle is aligned in a parallel configuration with a corresponding sleeve attached to the opposite edge of the handle.

BRIEF DESCRIPTION OF THE DRAWINGS

These and other features, aspects, and advantages of the present invention will become better understood with regard to the following description, appended claims, and accompanying drawings where:

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate manner.

Where reference is made herein to a method comprising two ore more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The present invention provides for a carrier for holding one or more containers wherein said containers are each separately enclosed by a sleeve, and each sleeve can be individually removed from the remainder of the carrier. When each sleeve is removed from the remainder of the carrier, each sleeve retains its shape. In one use of the present invention, the carrier holds a six pack of bottled beverages, such as beer or soda. Another feature of the present invention is that each of the sleeves serves to insulate the bottle contained therein, both while the sleeves are attached to the carrier and after they have been removed from the remainder of the carrier. Because of the removable insulated sleeves, the user does not have to use an additional insulating device, wherein said insulating devices are also referred to as koozies, huggies, can coolers, etc. Moreover, the carrier of the present invention can be formed from a variety of materials, including, but not limited to, paperboard, cardboard, chipboard, posterboard, polystyrene foam, fabric, balsa wood, corrugated cardboard, corrugated plastic, plastic sheeting, neoprene, foam rubber, any combination of the foregoing, and other similar materials known in the art.

One embodiment of the beverage carrier 1 of the present invention is depicted in FIGS. 1-5 and 9-14. We speculate that this embodiment of the carrier 1 of the present invention utilizes less material and glue than the average beverage carrier already in the marketplace, and that it can be assembled using automated machinery or by hand. Additionally, we speculate that the construction of the carrier 1 of this embodiment of the present invention requires fewer steps than the method of constructing the average beverage carrier already in the marketplace.

Figure 1:
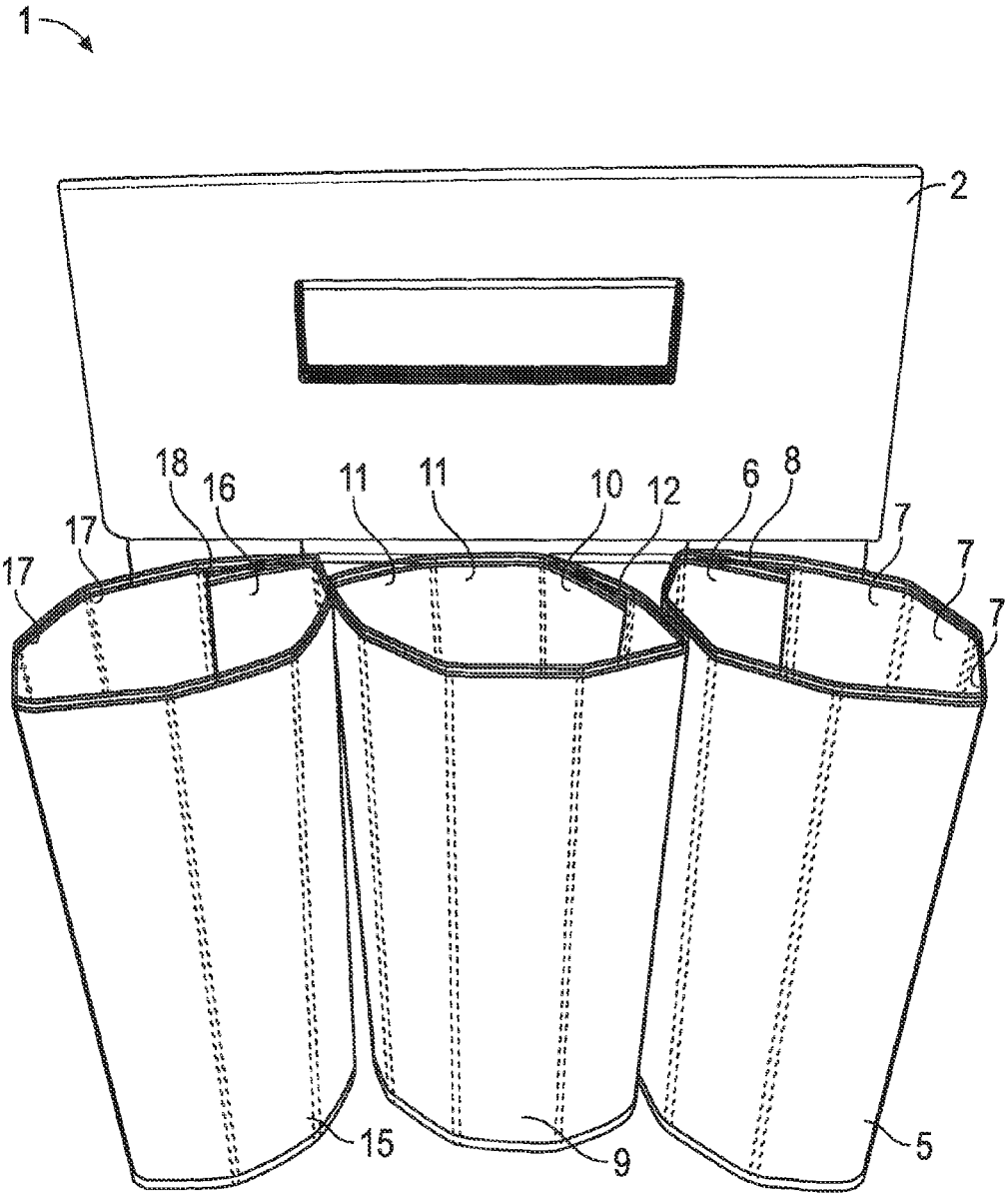
FIG. 1 depicts a side view of the beverage carrier of the present invention.
Figure 2:
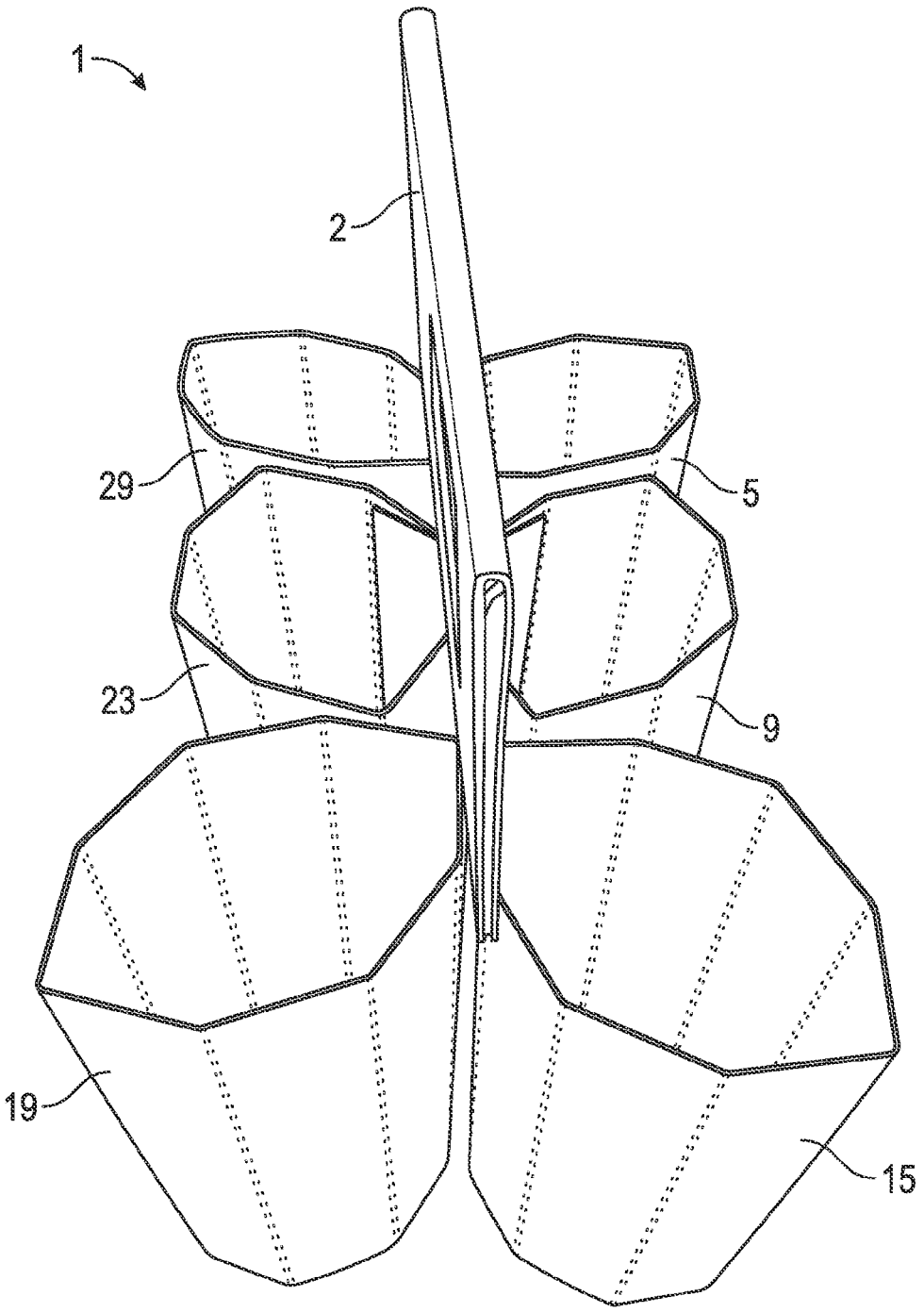
FIG. 2 depicts a perspective view of the beverage carrier of the present invention.
Figure 3:
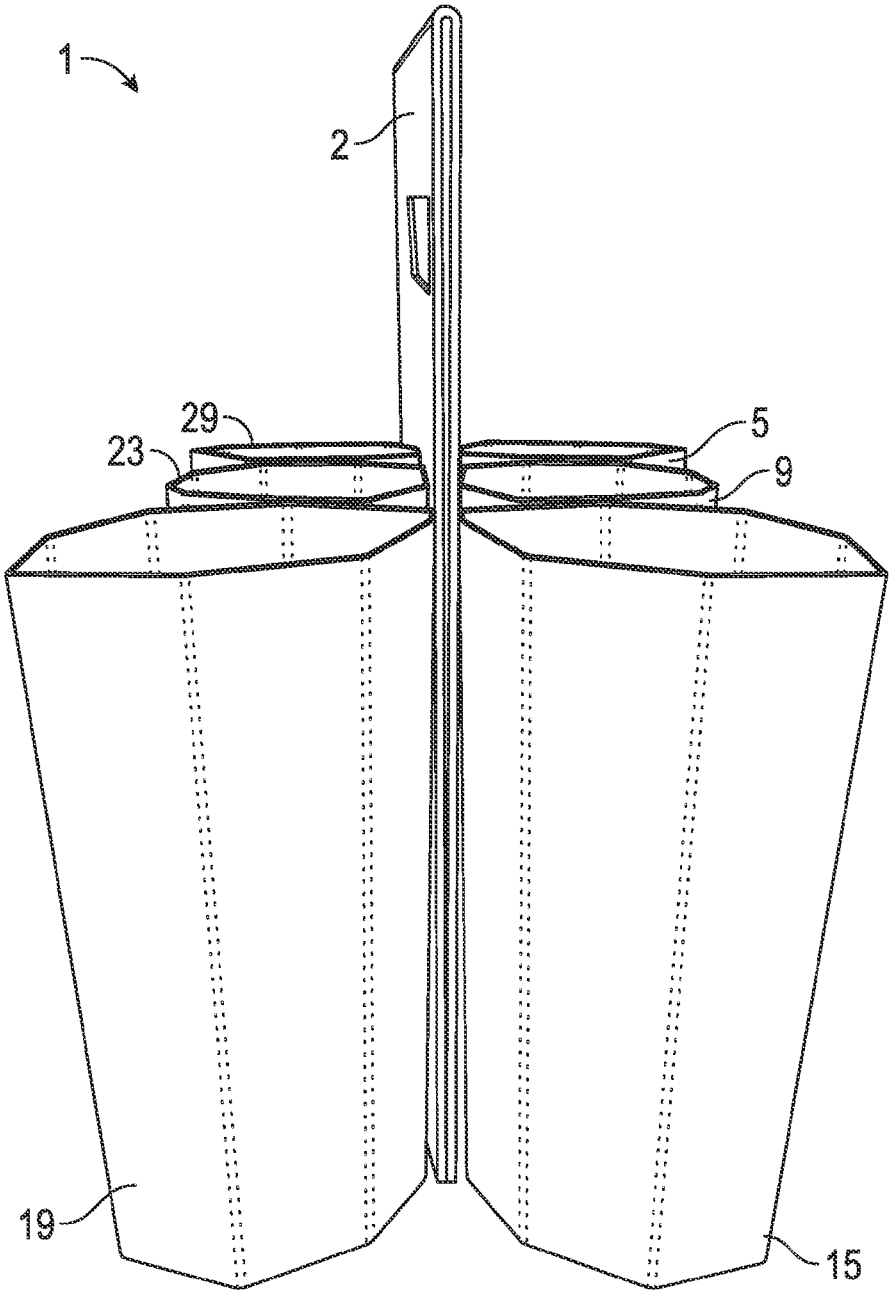
FIG. 3 depicts a front view of the beverage carrier of the present invention.
Figure 4:
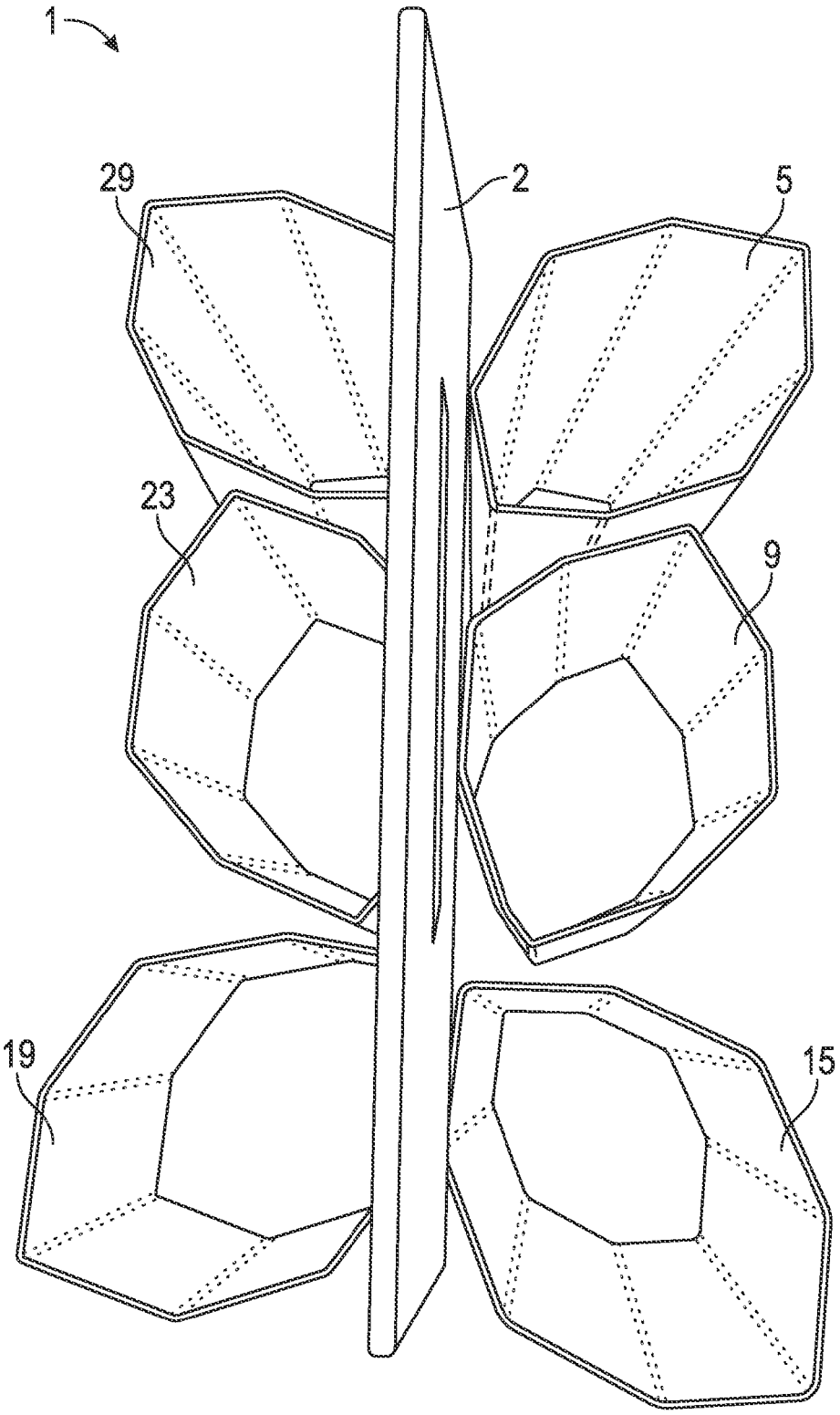
FIG. 4 depicts a top view of the beverage carrier of the present invention.
Figure 5:
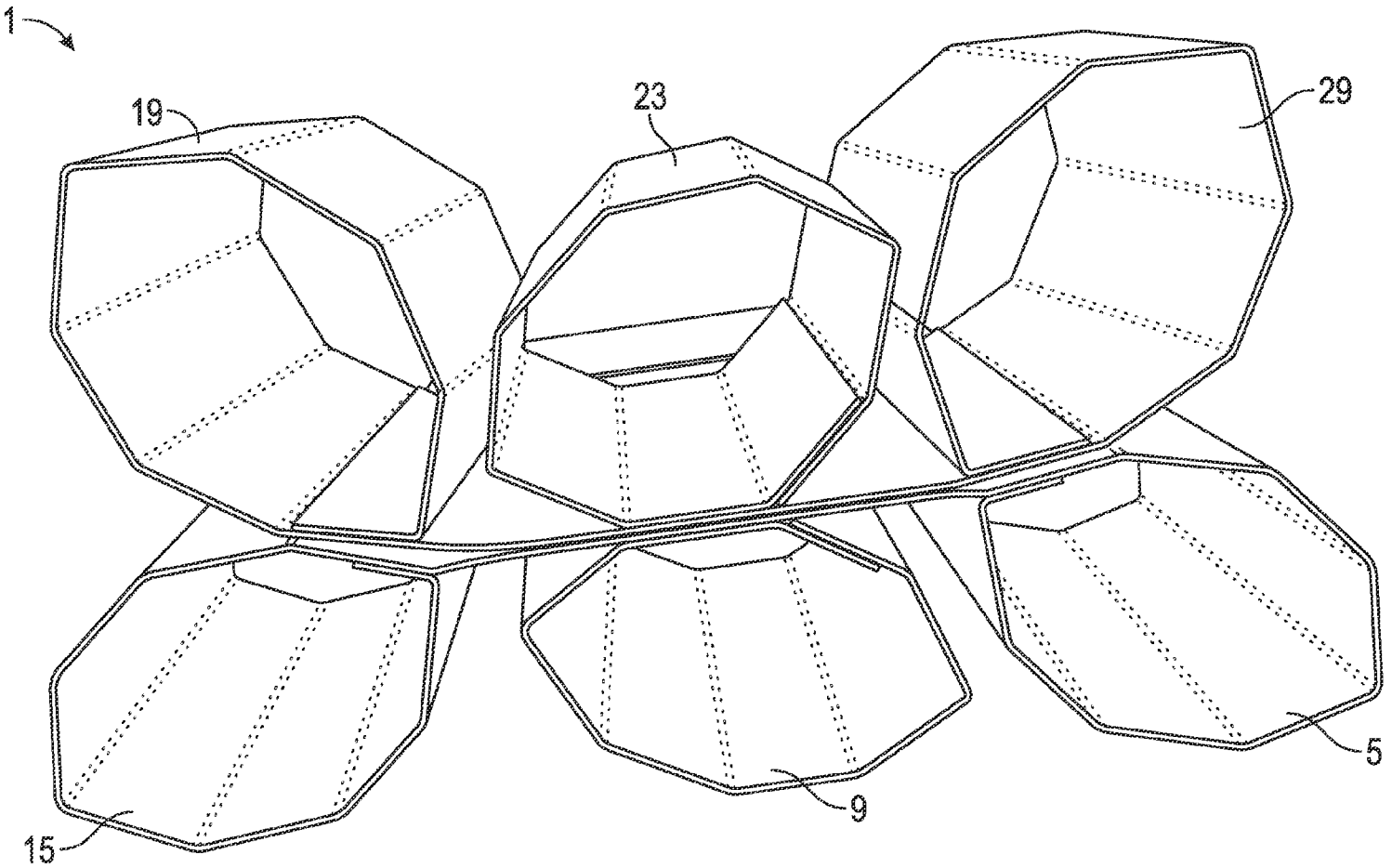
FIG. 5 depicts a bottom view of the beverage carrier of the present invention.

As can be seen in FIG. 2, this embodiment comprises six sleeves 5, 9, 15, 19, 23, 29 positioned in two parallel rows. Specifically, a first sleeve 5, second sleeve 9, and third sleeve 15 are attached to one side of a handle 2 while a fourth sleeve 19, fifth sleeve 23, and sixth sleeve 29 are attached to the opposite side of the handle 2. As shown, for example, in FIGS. 1 and 7, each sleeve 5, 9, 15, 19, 23, 29 comprises a sleeve attachment flap 6, 10, 16, 20, 24, 30 and a series of sleeve panels 7, 11, 17, 21, 25, 31. One of said sleeve panels 7, 11, 17, 21, 25, 31 of each sleeve 5, 9, 15, 19, 23, 29 is a sleeve attachment panel 8, 12, 18, 22, 26, 32. Each sleeve 5, 9, 15, 19, 23, 29, which, in the present embodiment, is generally cylindrical in shape, is formed by attaching said sleeve attachment flap 6, 10, 16, 20, 24, 30 to the sleeve's respective sleeve attachment panel 8, 12, 18, 22, 26, 32. The sleeve attachment flaps 6, 10, 16, 20, 24, 30 may be attached to each respective sleeve attachment panel 8, 12, 18, 22, 26, 32 using glue (such as a wet set glue), or, alternatively, using interlocking tabs, structured board (i.e., one-way insertion methods), hinges, tacks, staples, zippers, hook and loop tape (e.g., "Velcro"), sewn thread, springs, clips, buckles, hooks, magnets, nails, screws, suction, or any similar attachment means know in the art.

For example, and as shown in FIG. 1, to create the generally cylindrical shape of the first sleeve 5, said first sleeve attachment flap 6 is glued to the first sleeve attachment panel 8. Similarly, to create the cylindrical shape of the second sleeve 9, said second sleeve attachment flap 10 is glued to the second sleeve attachment panel 12. This same method of creating the generally cylindrical shaped sleeves is repeated for each individual sleeve (e.g, the third sleeve 15, the fourth sleeve 19, the fifth sleeve 23 and the sixth sleeve 29). Additionally, the sleeves 5, 9, 15, 19, 23, 29 may be folded to create sleeve panels 7, 11, 17, 21, 25, 31 in each of the sleeves 5, 9, 15, 19, 23, 29. Before each sleeve is formed into a generally cylindrical shape, each sleeve 5, 9, 15, 19, 23, 29 may be folded at intervals along one or more latitudinal lines to create two or more sleeve panels 7, 11, 17, 21, 25, 31 for each sleeve 5, 9, 15, 19, 23, 29. The locations of exemplary folds in the sleeves 5, 9, 15, 19, 23, 29 are shown in FIGS. 1-5 by dotted lines. In this embodiment, folds are made at approximately one inch intervals along the length of each of the sleeves 5, 9, 15, 19, 23, 29 to create eight sleeve panels 7, 11, 17, 21, 25, 31 in each sleeve 5, 9, 15, 19, 23, 29. However, a greater or lesser number of folds may be included to create more or fewer sleeve panels 7, 11, 17, 21, 25, 31. The folding of the sleeves 5, 9, 15, 19, 23, 29 to create sleeve panels 7, 11, 17, 21, 25, 31 allows the material making up the sleeves 5, 9, 15, 19, 23, 29 to more easily bend into a generally cylindrical shape. Additionally, the folding of the sleeves 5, 9, 15, 19, 23, 29 allows for the beverage carrier 1 to be compressed flat after all beverage containers have been removed from the beverage carrier 1, and thus allows for easy storage or disposal of the beverage carrier 1.

Figure 6:
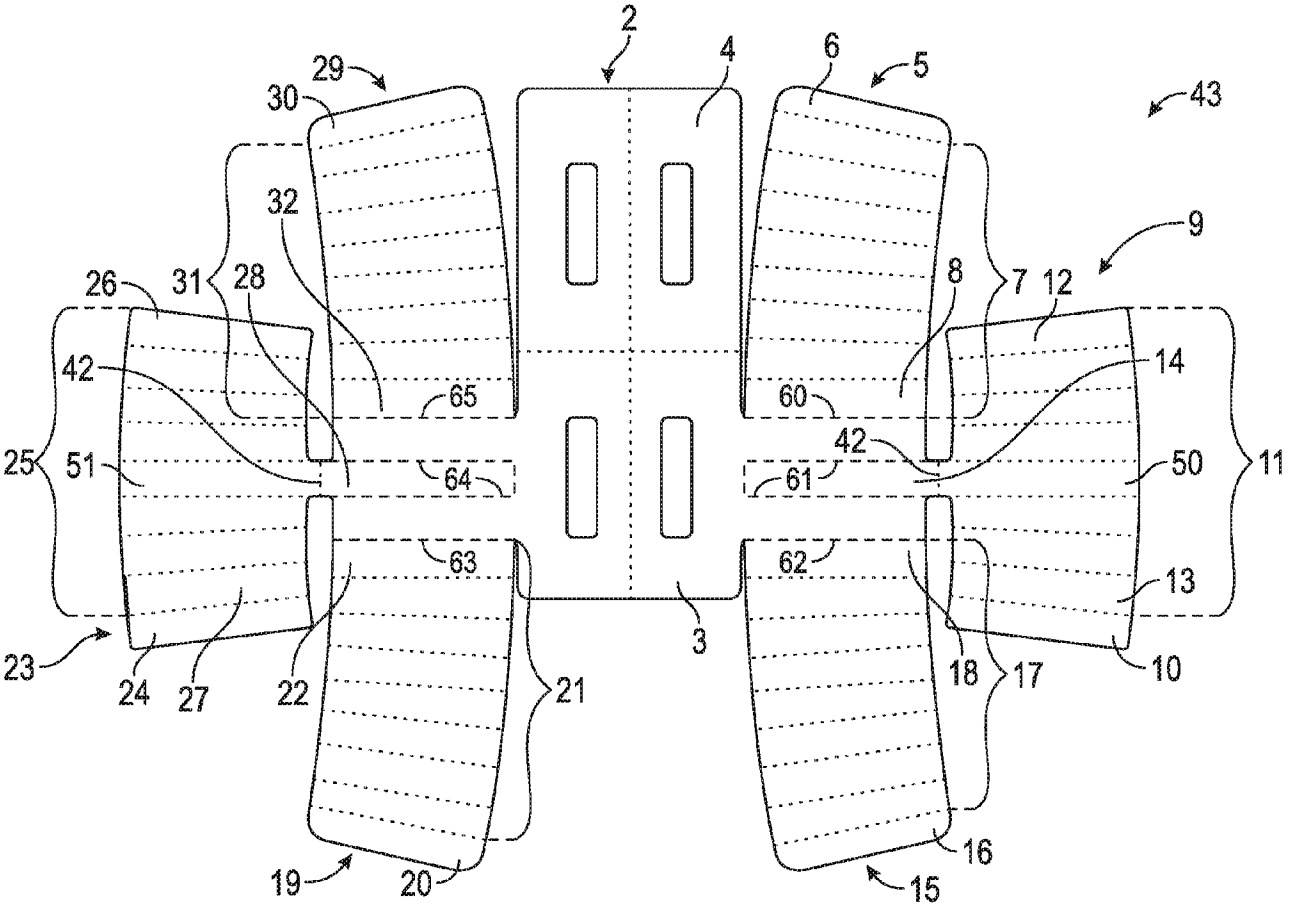
FIG. 6 depicts an elevational view of a paperboard blank cut to create one embodiment of the beverage carrier of the present invention.
Figure 7:
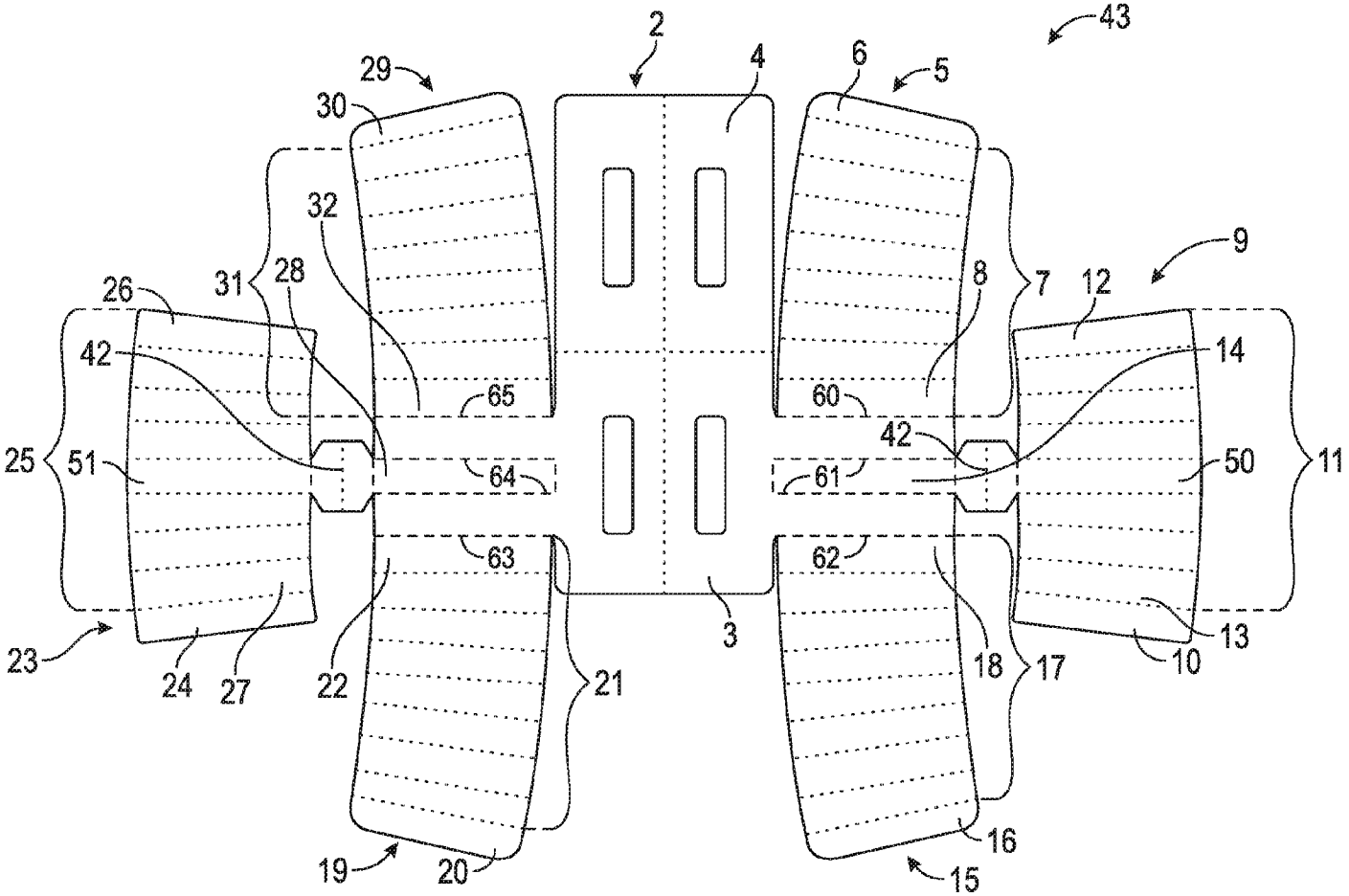
FIG. 7 depicts an elevational view of a paperboard blank cut to create one embodiment of the beverage carrier of the present invention.
Figure 8:
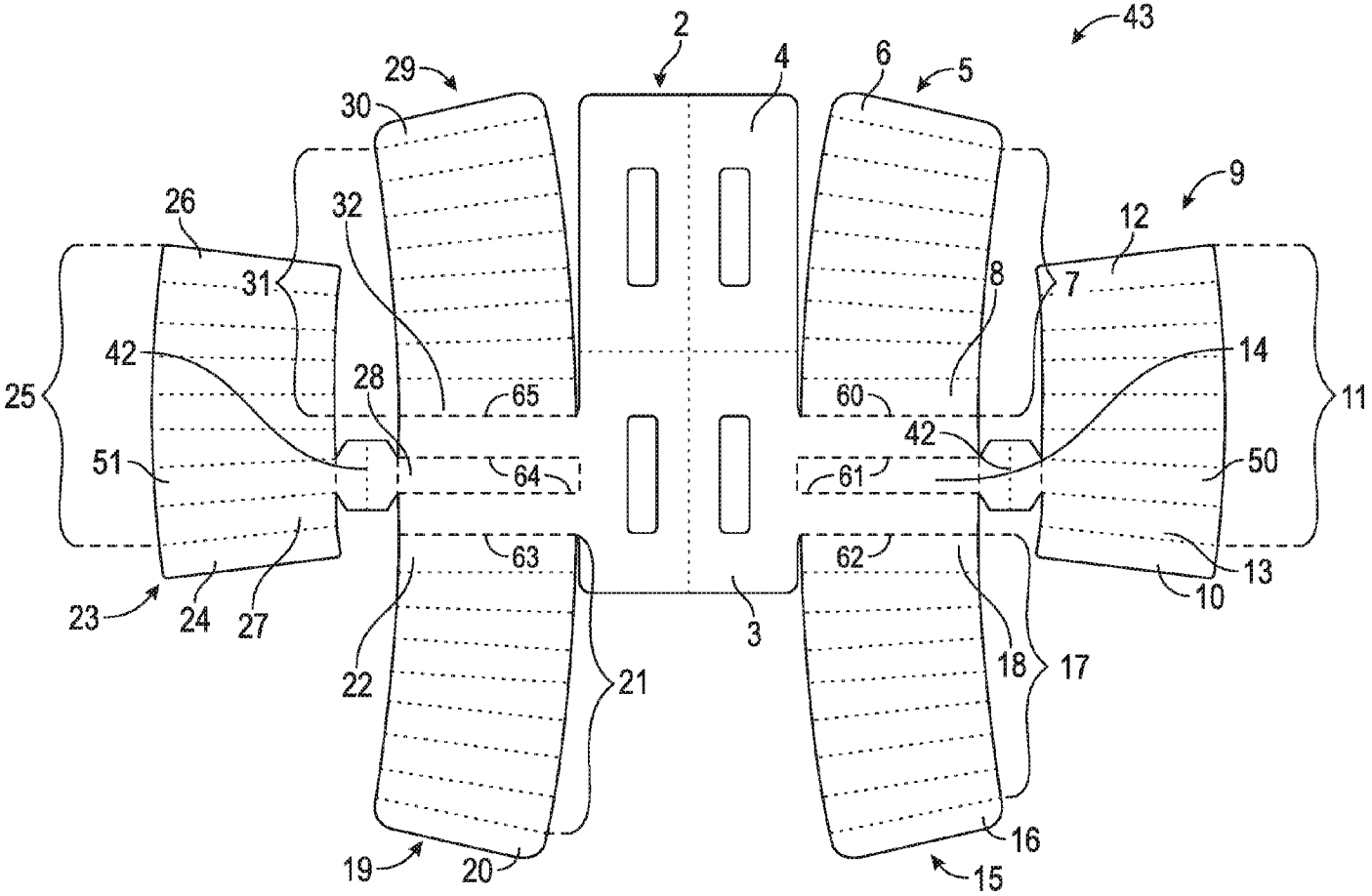
FIG. 8 depicts an elevational view of a paperboard blank cut to create one embodiment of the beverage carrier of the present invention.

As illustrated in FIGS. 6-8, the second sleeve 9 and the fifth sleeve 23 each further comprise a second sleeve inner attachment panel 13 and a fifth sleeve inner attachment panel 27, respectively, as well as a second sleeve center attachment panel 50 and a fifth sleeve center attachment panel 51, respectively. In a preferred embodiment, as illustrated in FIG. 7, the bottom side of each of the second and fifth sleeve inner attachment panels 13, 27 is attached to the top side of a corresponding handle attachment panel 14 and 28, respectively, during manufacturing of the beverage carrier 1 (as described in further detail below). In an alternative embodiment, the top side of each of the second and fifth sleeve center attachment panels 50, 51 is attached to the top side of each corresponding handle attachment panel 14 and 28, respectively, during manufacturing. The process of manufacturing the beverage carrier 1 will be discussed below in detail.

Figure 15:
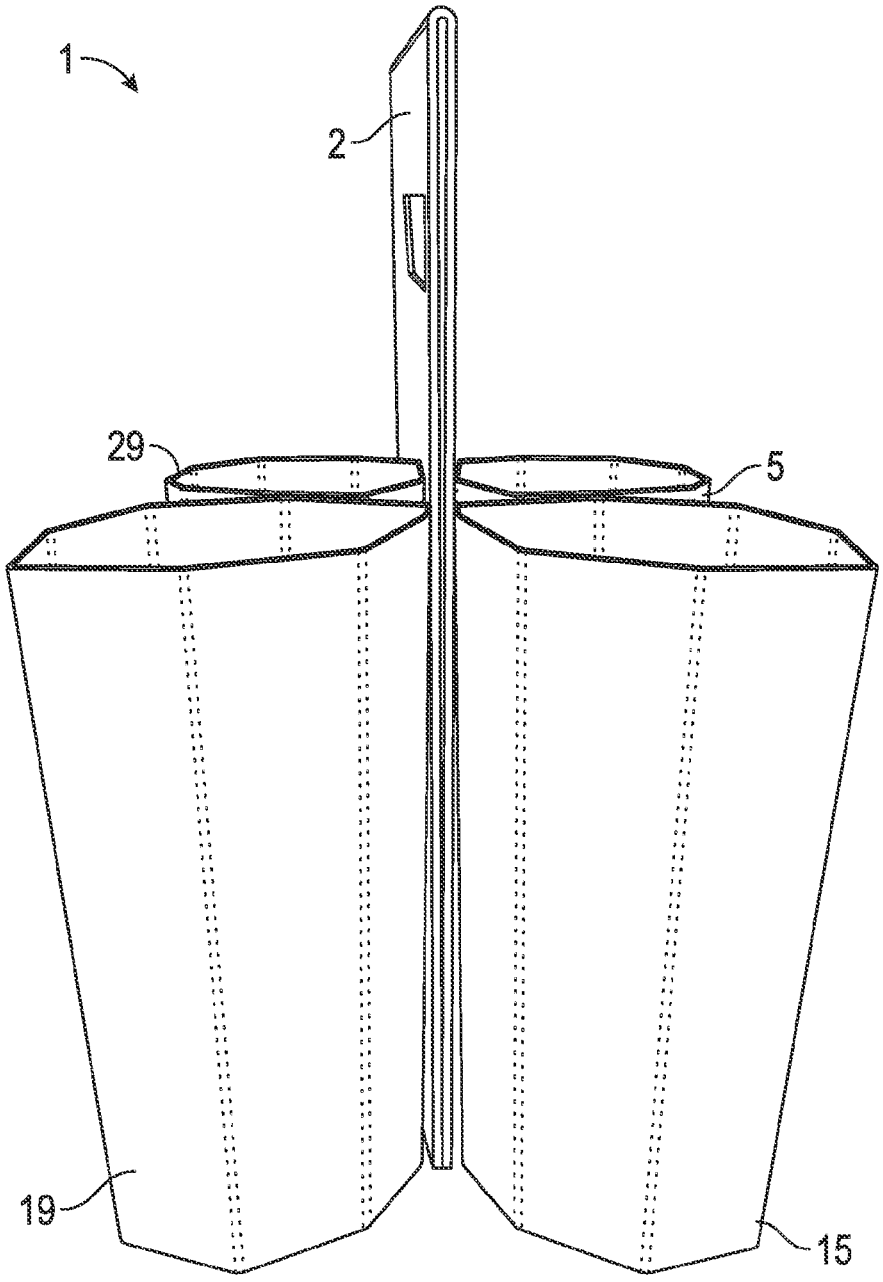
FIG. 15 depicts an alternative embodiment of the beverage carrier of the present invention wherein said carrier comprises four sleeves.

FIGS. 1-5 depict a beverage carrier 1 comprising six sleeves. However, the beverage carrier 1 of the present invention may comprise any number of sleeves, including, but not limited to, two sleeves or four sleeves. For example, FIG. 15 shows an alternate embodiment wherein the beverage container 1 comprises four sleeves 5, 15, 19, 29. Also, in yet another alternative embodiment, the handle 2 may have an alternative three-dimensional shape such as a circular or square shape (instead of a flat shape), and the sleeves 5, 9, 15, 19, 23, 29 may be attached to the perimeter of the three-dimensional handle.

Figure 12:
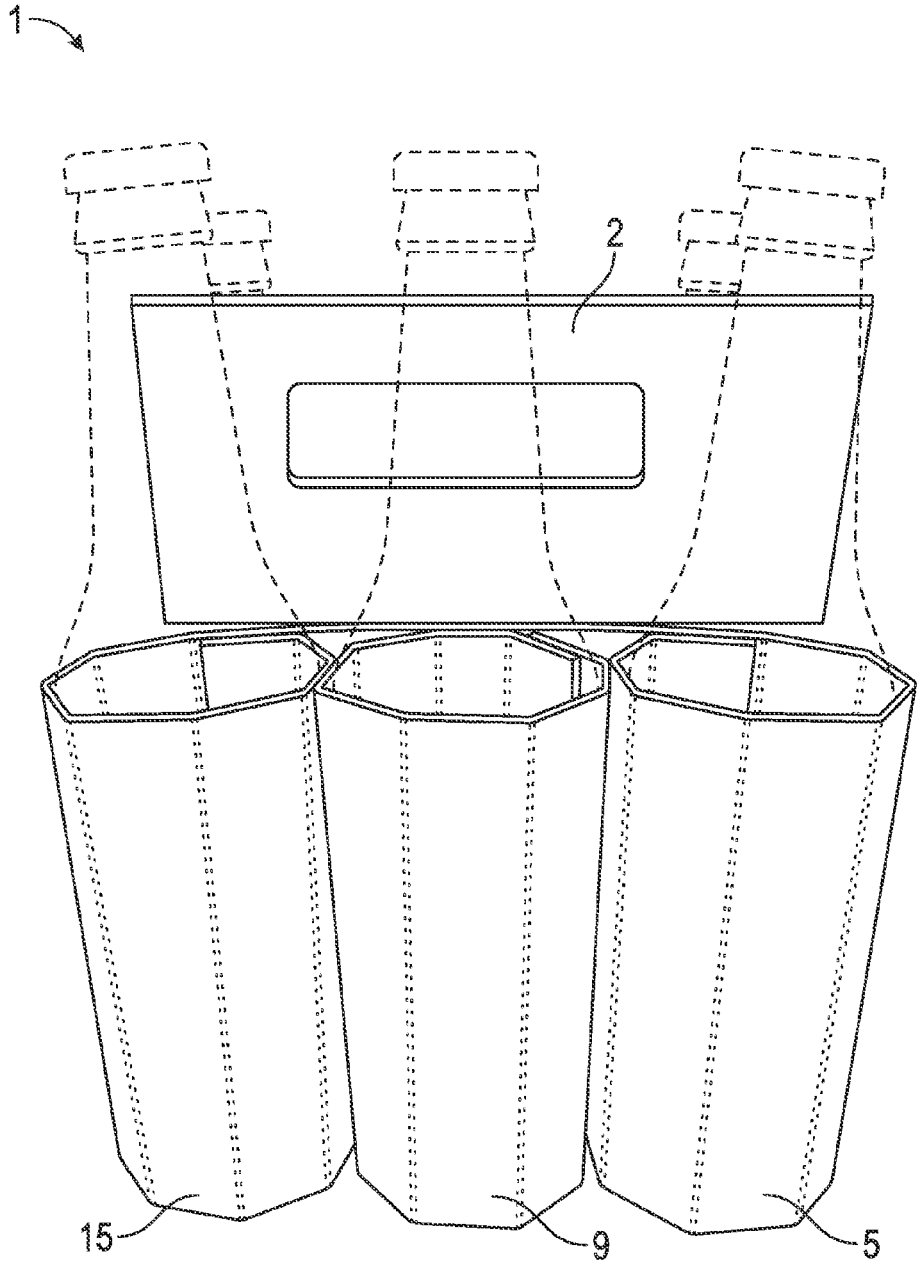
FIG. 12 depicts a front view of the beverage carrier of the present invention with bottles inserted into the sleeve bodies.
Figure 13:
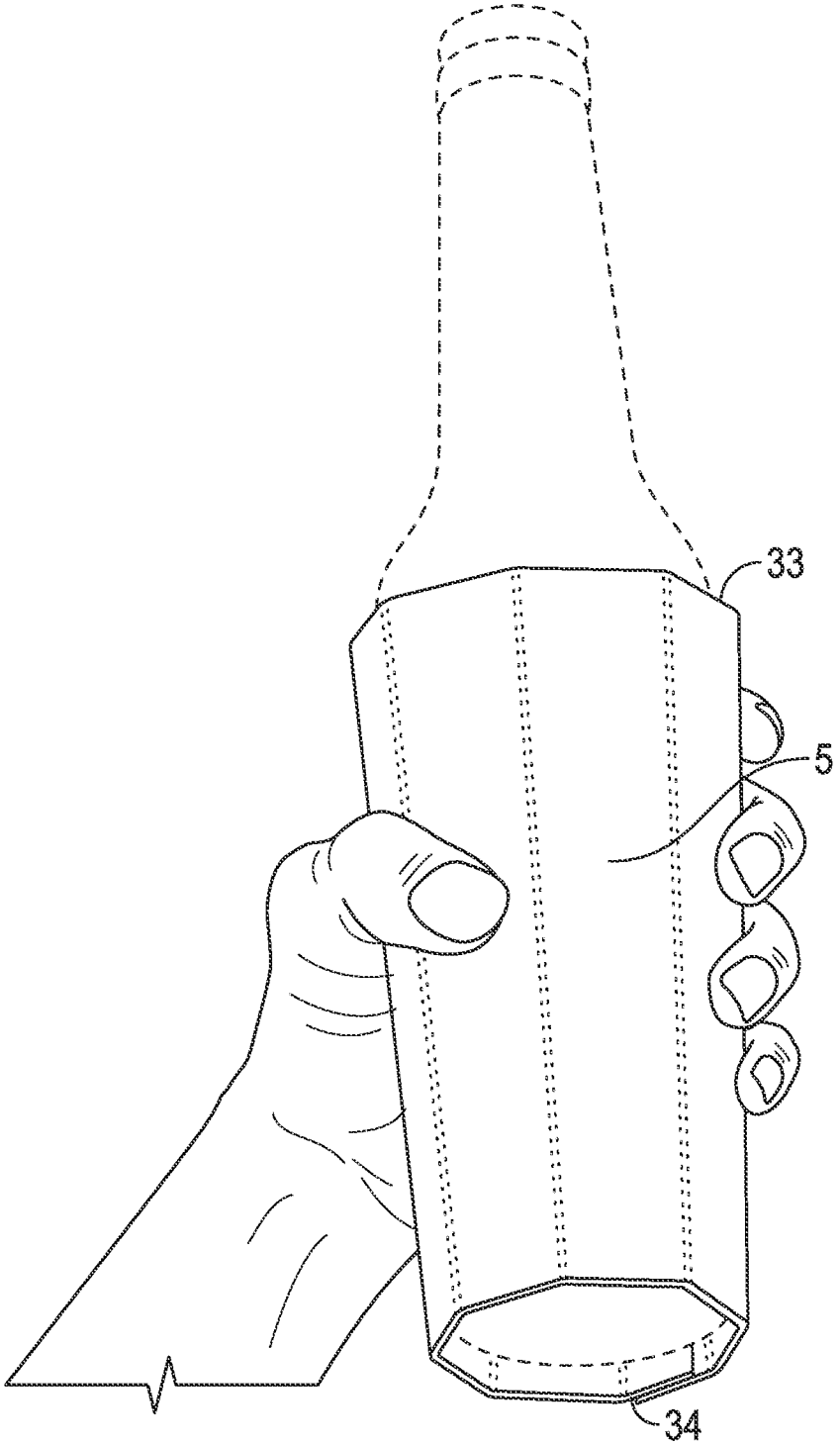
FIG. 13 depicts a beverage container within a detached sleeve of the beverage carrier.

The sleeves 5, 9, 15, 19, 23, 29 shown in FIGS. 1-8 and 10-15 are approximately five inches tall. However, the sleeves can be taller or shorter depending on manufacturer and/or customer preferences. Another feature of the sleeves, as shown in FIG. 13, is that the upper sleeve circumference 33 is greater than that of the lower sleeve circumference 34. Because the upper sleeve circumference 33 is greater, the tapered sleeve design allows a container to be placed into the sleeve from the top of the sleeve 9, 15, 19, 23, 29, but prevents the container from sliding completely through the sleeve. In other words, the tapered design of the sleeve secures the container within the sleeve 9, 15, 19, 23, 29. Each of the sleeves shown in these embodiments has an upper sleeve diameter of approximately 2.5 inches when the sleeve is expanded to its largest diameter, for instance, when the sleeve is surrounding a beverage container. Each sleeve has a lower sleeve diameter of approximately 2.125 inches. However, the lower sleeve circumference 34 and the upper sleeve circumference 33 may be smaller or larger to accommodate various sized containers.

Figure 14:
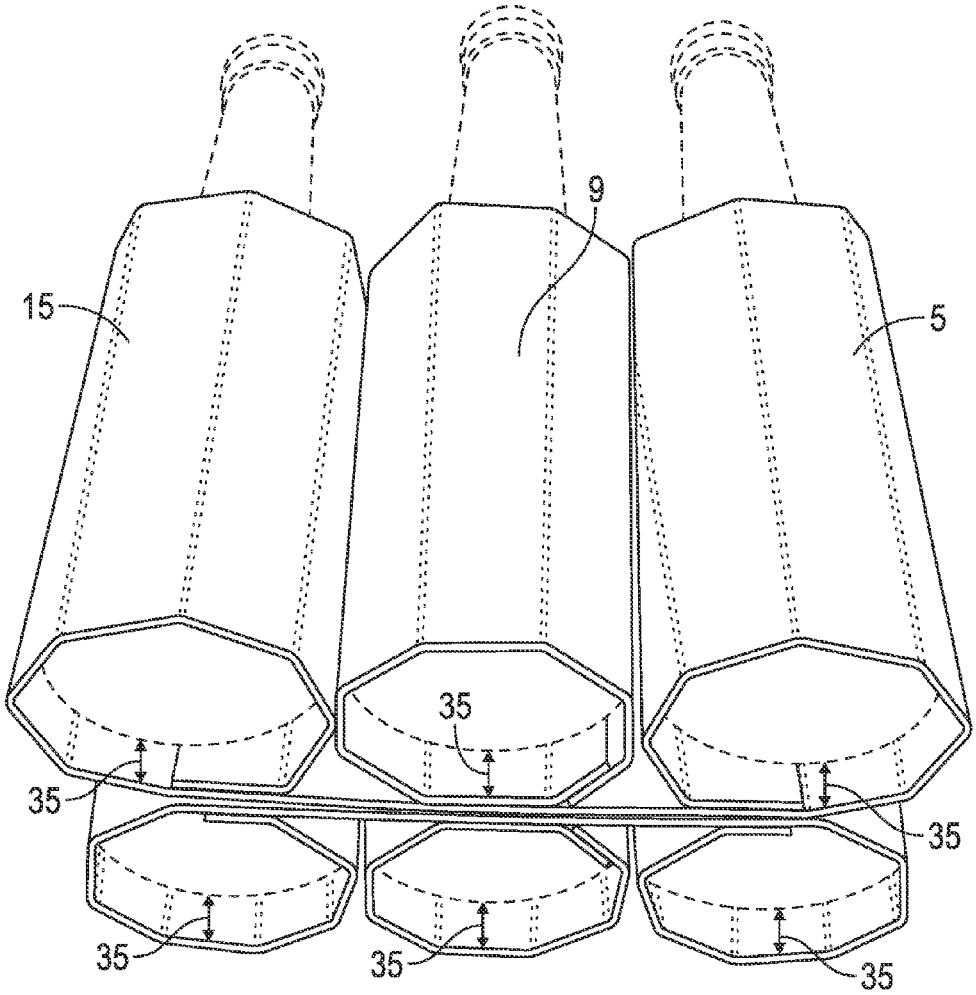
FIG. 14 depicts a perspective view of the beverage carrier of the present invention with bottles inserted into the sleeve bodies.

As can be seen in FIGS. 13 and 14, the particular dimensions of the lower sleeve circumference 34 and the upper sleeve circumference 33 recited above (namely, an upper diameter of 2.5 inches and a lower diameter of 2.125 inches) allow a standard twelve ounce glass beer bottle to be slipped into the top of the sleeve 5, 9, 15, 19, 23, 29 but will not allow the bottle to pass all the way through. It is an additional benefit of this invention that the distance between the bottom of the sleeve 5, 9, 15, 19, 23, 29 and the bottom of the container (the lower void 35) provides added protection to the beverage containers contained within the beverage carrier 1. In this particular embodiment, the lower void 35 is approximately 0.3125 inches long. The lower void 35 aids in preventing glass containers from breaking if the beverage carrier 1 is dropped by the user.

FIGS. 6-8 illustrate exemplary embodiments of a cut-out template 43 which may be used to make a beverage carrier 1 having six sleeves. Each sleeve 5, 9, 15, 19, 23, 29 is attached to the handle 2 along a respective perforated attachment surface 60, 61, 62, 63, 64, 65, as illustrated in FIGS. 6-8. When the carrier 1 is assembled and in an upright position resting on the bottoms of the sleeves 5, 9, 15, 23, 29, each perforated attachment surface is configured in a generally vertical position along the exterior of each respective three-dimensional sleeve 5, 9, 15, 19, 23, 29, as indicated in FIG. 1. FIGS. 6-8 illustrate the generally straight and generally vertical configuration of each perforated attachment surface 60, 61, 62, 63, 64, 65 relative to each respective sleeve 5, 9, 15, 19, 23, 29 prior to assembly of the carrier 1. Thus, each perforated attachment surface 60, 61, 62, 63, 64, 65 extends vertically in a generally straight line along the exterior of each sleeve 5, 9, 15, 19, 23, 29 rather than horizontally along a curved line around the circular perimeter of the sleeve.

FIG. 7 depicts an elevational view of a paperboard cut to create the beverage carrier 1 shown in FIGS. 1-5. FIGS. 6 and 8 each depict an elevational view of a paperboard cut to create an alternative embodiment of beverage carrier 1. Advantageously, the beverage carrier 1 may be cut from a blank, or, in other words, a single piece of paperboard or other material. For example, a 24 inch by 21.5 inch piece of 18 point or 24 point AquaKote® (Wet Strength CCK) paperboard may be used as the blank. In FIGS. 6-8, the solid lines indicate cuts that are to be made to the blank to create the specific shape of the beverage carrier template 43. The dotted lines indicate folds that are made to the blank, and the dashed lines indicate perforations that are made to the blank.

The beverage carrier templates 43 can be cut and assembled by manual or by automated means already known in the art. The following describes one method of creating a beverage carrier 1 using automated means. In the following description, the blank is referred to as having a top side and a bottom side wherein the top side faces upwards and the bottom side faces downwards during assembly. Referring to FIGS. 6-8, which depict an aerial view looking downward on the top side of the blank, the blank may be cut and perforated using an automated die cutter, such as a BOBST® Flatbed Die-Cutter. The die cutter, using the schematic that is uploaded to the die cutter (where FIGS. 6-8 are materially similar to such a schematic), makes cuts corresponding to the solid lines and further makes perforations corresponding to the dashed lines. The perforations, which are a combination of punctures and small cuts, may comprise various sequences of punctures and cuts, and as an example, may comprise the alternating sequence of three punctures and one cut.

After the cuts and perforations are made by the die cutter, the beverage carrier template 43 is assembled by a folder-gluer line (such as a BOBST® Folder Gluer). The folder-gluer line, using the schematic that is uploaded to the folder-gluer line (where FIGS. 6-8 are materially similar to such a schematic), first makes folds (also known as scores) to the beverage carrier template 43 corresponding to the dotted lines of the schematic. The folder-gluer line then applies glue to the template 43 in the appropriate locations for assembling the carrier 1, depending on the particular embodiment of the carrier 1 and the particular template 43 used.

FIG. 7 illustrates a preferred embodiment of the template 43. In a preferred embodiment, the folder-gluer line applies glue to the bottom side of each of the sleeve attachment flaps 6, 10, 16, 20, 24, 30, to the top side of a first handle attachment panel 14, to the top side of a second handle attachment panel 28, and to the top side of the inner portion 4 of handle 2. Alternatively, or in addition to, glue may also be applied to the top side of each of the sleeve attachment panels 8, 12, 18, 22, 26, 32, and to the bottom side of each of the second and fifth sleeve inner attachment panels 13, 27.

Next, the folder-gluer line attaches the bottom side of the first sleeve attachment flap 6 to the top side of the first sleeve attachment panel 8 by bending the attachment flap 6 upward and curving the flap 6 until it touches the attachment panel 8. This step forms the generally cylindrical first sleeve 5. Similarly, the folder-gluer line next attaches the bottom side of the sixth sleeve attachment flap 30 to the top side of the sixth sleeve attachment panel 32 in the same manner to form the generally cylindrical sixth sleeve 29. Then, the folder-gluer line attaches the bottom side of the third sleeve attachment flap 16 to the top side of the third sleeve attachment panel 18 to form the generally cylindrical third sleeve 15, and also attaches the bottom side of the fourth sleeve attachment flap 20 to the top side of the fourth sleeve attachment panel 22 to form the generally cylindrical fourth sleeve 19.

In a preferred embodiment, the folder-gluer line then attaches the bottom side of the second sleeve attachment flap 10 to the top side of the second sleeve attachment panel 12 by bending both the flap 10 and the panel 12 upward until the flap 10 touches the panel 12. This step forms the generally cylindrical second sleeve 9. Similarly, the folder-gluer line next attaches the bottom side of the fifth sleeve attachment flap 24 to the top side of the fifth sleeve attachment panel 26 to form the generally cylindrical fifth sleeve 23.

The folder-gluer line then folds the second sleeve 9 and the fifth sleeve 23 upward (with each connection tab 42 acting as a hinge to the fold) so that the bottom side of the second sleeve inner attachment panel 13 is attached to the top side of the first handle attachment panel 14, and the bottom side of the fifth sleeve inner attachment panel 27 is attached to the top side of the second handle attachment panel 28. After attachment of the second and fifth sleeves 9, 23 to the handle 2, each of the tabs 42 are removed from the assembly by tearing the tabs 42 along the perforations on each side of each tab 42. Removal of the tabs 42 from the assembly will allow the second and fifth sleeves 9, 23 to expand so that each sleeve may be used to hold a beverage container.

The inner portion 4 of the handle 2 is then folded downward under the outer portion 3 of the handle 2, and the handle 2 is folded in half (as illustrated with the dotted lines shown in FIGS. 6-8) to create the assembled beverage carrier 1. After the handle 2 is folded in half, the first, second, and third sleeves 5, 9, 15 will be aligned in a parallel configuration with the fourth, fifth, and sixth sleeves 19, 23, 29, as illustrated in FIG. 2. In other words, the beverage carrier 1 will have three sleeves on either side of the handle 2, thereby forming a symmetrical carrier 1 designed to carry six individual beverage containers.

In an alternative embodiment, the second sleeve 9 and the fifth sleeve 23 may be attached to the handle attachment panels, 14 and 28, respectively, by gluing the bottom side of the second and fifth sleeve attachment panels 12, 26 to the handle attachment panels, 14 and 28, respectively. In fact, it should be understood by one skilled in the art that any of the sleeve panels illustrated may be used for attachment to the handle and still fall within the scope of the present invention.

In another alternative embodiment, the second sleeve 9 and the fifth sleeve 23 can be formed by bending the respective sleeve attachment panels 12, 26 and sleeve attachment flaps 10, 24 downward until each of the flaps 10, 24 touches the corresponding panels 12, 26. In this embodiment, the second and fifth sleeves 9, 23 are then folded upward so that each center attachment panel 50, 51 is attached to its corresponding handle attachment panel 14, 28. Thus, in this embodiment, the attachment panels 12, 26 and the attachment flaps 10, 24, which overlap and are glued together, are positioned on the outside of the sleeves 9, 23 when viewing the assembled carrier 1. However, it is preferred that the outside portions of the sleeves have a smooth continuous surface for the purpose of printing on the sleeves and generally for aesthetic purposes. Thus, this embodiment is not the most preferred.

An alternative embodiment of the present invention utilizes the template illustrated in FIG. 6. The primary advantage of this template is that it utilizes less material due to the smaller size of the connection tabs 42. In this embodiment, the second and fifth sleeves 9, 23 may be formed by bending the respective attachment panels 12, 26 and attachment flaps 10, 24 upward or downward, as described above. In addition, the second and fifth sleeves 9, 23 may be attached to the respective handle attachment panels 14, 28 in any manner described above. After assembly, each of the tabs 42 are torn along the perforations illustrated on each tab 42. By tearing each tab 42, the second and fifth sleeves 9, 23 are allowed to expand so that each sleeve may be used to hold a beverage container.

Another alternative embodiment of the present invention utilizes the template illustrated in FIG. 8. In this embodiment, the location where the tabs 42 are connected to the second and fifth sleeves 9, 23 are offset from the center of the sleeves 9, 23. The second and fifth sleeves 9, 23 of this embodiment may be formed in any manner described above. However, in this embodiment, it is preferred to attach the second and fifth sleeves 9, 23 to the handle 2 by attaching the bottom side of each inner attachment panel 13, 27 to the corresponding handle attachment panel 14, 28, though any method of attachment described above may also be utilized. Depending on the material of construction, this configuration of the template may make it easier to attach the bottom side of each inner attachment panel 13, 27 to the corresponding handle attachment panel 14, 28.

Although the methods described above produce a beverage carrier 1 designed to carry six beverage containers, the method may be adapted to produce a beverage carrier 1 designed to carry any number of beverage containers, and particularly a carrier 1 for carrying four beverage containers, as illustrated in FIG. 15. To produce the carrier 1 of the embodiment shown in FIG. 15, the template 43 can be modified to exclude the second and fifth sleeves 9, 23 (this template is not shown in the drawings). In this embodiment, the first, third, fourth, and sixth sleeves 5, 15, 19, 29 are then formed into three-dimensional sleeves and attached to the handle 2 in any manner described above. The handle 2 is then folded over, as described above, to form the beverage carrier 1.

After assembly, beverage containers can be placed into the sleeves either manually or by automated means. FIGS. 12-14 depict the assembled beverage carrier 1 with bottles inserted into the sleeves 5, 9, 15, 19, 23, 29. The perforations made during assembly allow for a user to easily detach the sleeves 9, 15, 19, 23, 29 from the beverage carrier 1 by pulling the sleeve (or by pulling on the bottle contained within the sleeve) away from the beverage carrier 1, thus tearing the perforated attachment surface 60, 61, 62, 63, 64, 65. As shown in FIG. 13, after detaching the sleeved container from the remainder of the beverage carrier 1, the sleeves 5, 9, 15, 19, 23, 29 remain structurally intact. In other words, after detaching a sleeved container, the user can then allow the sleeve 5, 9, 15, 19, 23, 29 to remain on the beverage container and use the sleeve 5, 9, 15, 19, 23, 29 as an insulating device for the container to reduce the transfer of heat from external heat sources, such as heat from the environment or heat from the user's hand, to the container during use. Conversely, the sleeve 5, 9, 15, 19, 23, 29 also protects the user's hand from becoming too cold when holding a cold beverage container. Additionally, although the device is typically used to insulate cold beverages, it may also be used in the same manner to insulate hot beverages.

Figure 9:
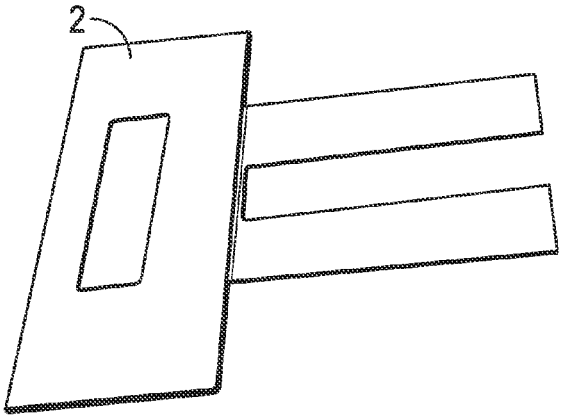
FIG. 9 depicts an elevational view of the handle after removal of all sleeve bodies.
Figure 10:
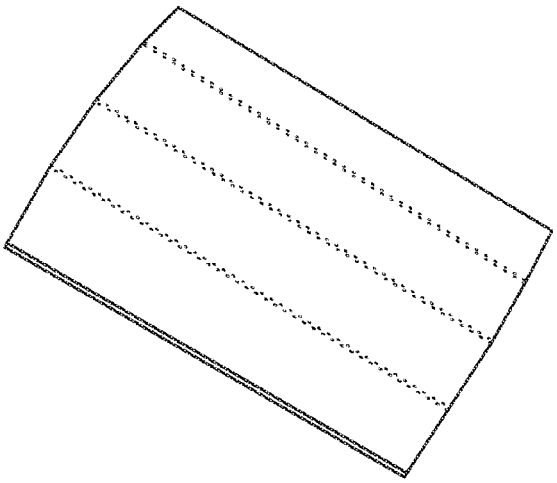
FIG. 10 depicts an elevational view of a single sleeve body while flattened.
Figure 11:
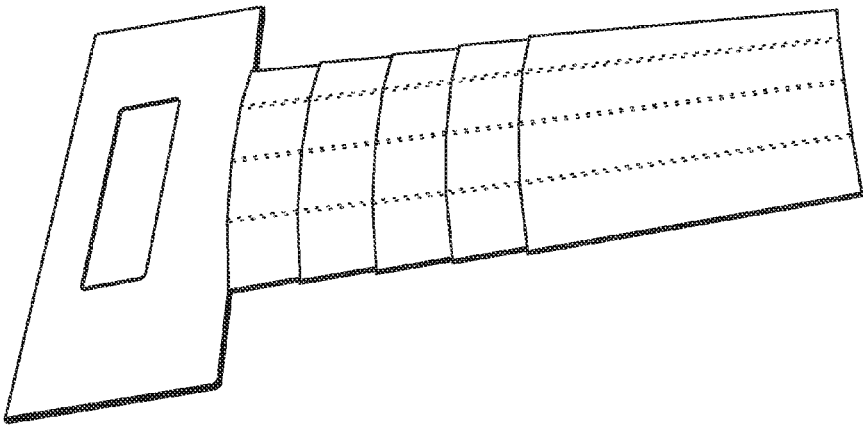
FIG. 11 depicts an elevational view of the storage of each of the sleeve bodies, after removal from the beverage carrier, using the handle of said beverage carrier.

Alternatively, if the bottles are going to be placed into an ice chest or a location where it is undesirable to have the containers in sleeves 5, 9, 15, 19, 23, 29, the user can remove the beverage containers from the sleeves 5, 9, 15, 19, 23, 29. Advantageously, as shown in FIGS. 9-11, the sleeves 5, 9, 15, 19, 23, 29 can then be nested within each other and stored on the handle 2 of the beverage carrier 1 for later use. As illustrated in FIG. 9, after all of the sleeves 5, 9, 15, 19, 23, 29 have been detached from the beverage carrier 1, the handle 2 remains. As illustrated in FIGS. 6-8 and described above in the assembly discussion, the handle 2 comprises an inner portion 4 folded underneath an outer portion 3. The handle 2 further comprises the portions of the handle that were previously (before detachment of the sleeves) bordered by the first handle attachment panel 14 and the first and third sleeve attachment panels 8, 18, as well as the portions of the handle previously bordered by the second handle attachment panel 28 and the fourth and sixth sleeve attachment panels 22, 32.

Figure 16:
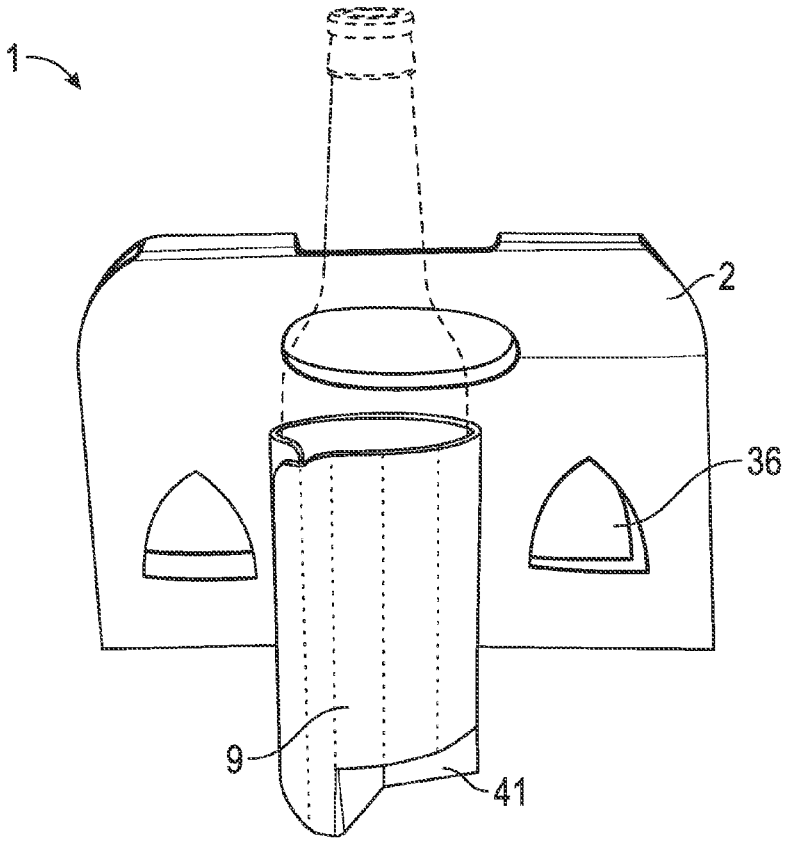
FIG. 16 depicts a side view of yet another alternate embodiment of the beverage carrier of the present invention.

An alternative embodiment of the present invention is shown in FIGS. 16-19. In this embodiment, the sleeves 5, 9, 15, 19, 23, 29 are detachable from the beverage carrier 1 using a lift-out design. As shown in FIG. 16, the handle 2 comprises six identical attachment windows 36. The attachment windows 36 in FIG. 16 are generally triangular in shape, but may alternatively be of another shape, such as a rectangle or square. The generally triangular attachment windows 36 of this embodiment are approximately 1.625 inches in height and have a base length of approximately 2.25 inches, but may be shorter or longer.

Figure 17:
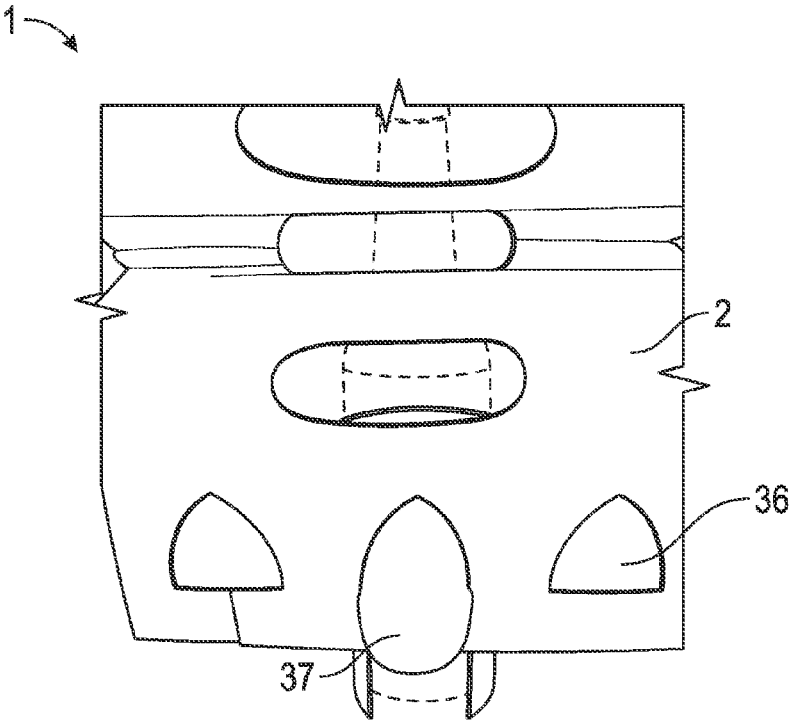
FIG. 17 depicts an interior view of an alternate embodiment of the beverage carrier of the present invention.
Figure 18:
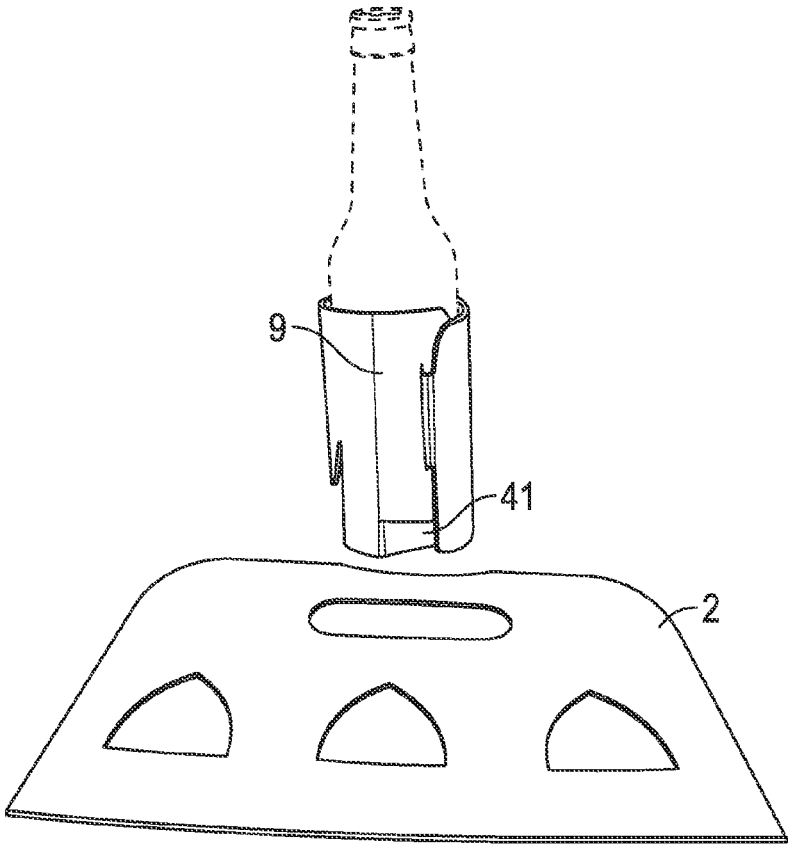
FIG. 18 depicts a view of the handle and a detached sleeve of an alternate embodiment of the beverage carrier of the present invention.
Figure 19:
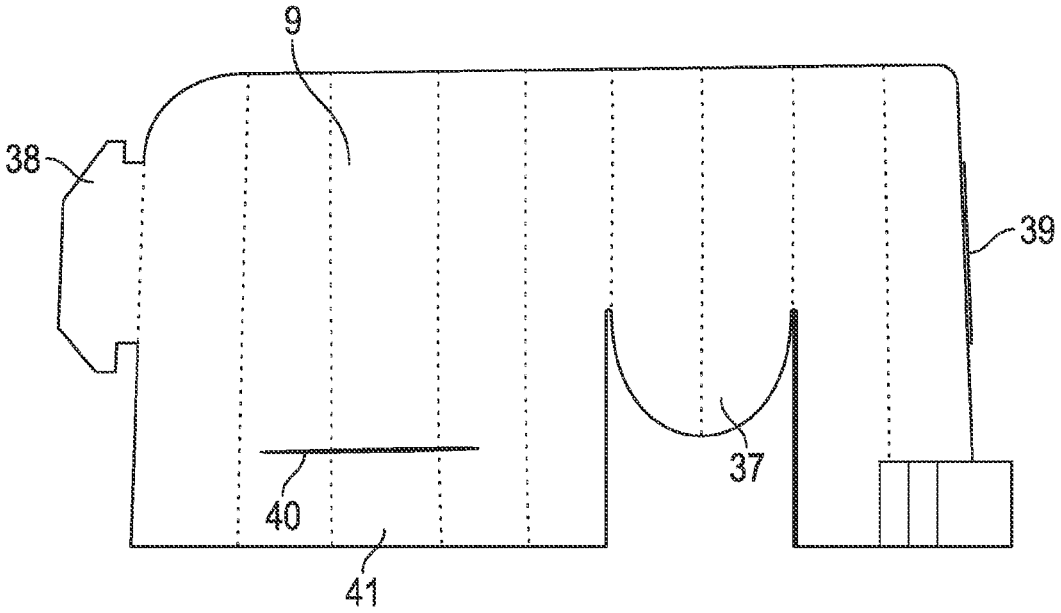
FIG. 19 depicts the sleeve (before assembly) of an alternate embodiment of the beverage carrier of the present invention.

As best seen in FIG. 19, each of the sleeves 5, 9, 15, 19, 23, 29 of this embodiment comprise an attachment skirt 37, a tab 38, a slot 39, a support cut 40, and a support segment 41. During assembly, the tab 38 of each of the sleeves 5, 9, 15, 19, 23, 29 is inserted into the respective slot 39 to create the generally cylindrical shape of the sleeves 5, 9, 15, 19, 23, 29. Alternatively, the generally cylindrical shape of the sleeves 5, 9, 15, 19, 23, 29 may be made by gluing or otherwise securing the edges of the sleeves as previously described (i.e., by utilizing the attachment flap and attachment panel design). The attachment skirt 37 of each sleeve 5, 9, 15, 19, 23, 29 can then be placed into each of the attachment windows 36, as shown in FIG. 17. To remove each of the sleeves 5, 9, 15, 19, 23, 29 of this particular embodiment, the user simply lifts the sleeves 5, 9, 15, 19, 23, 29 upwards. The sleeves 5, 9, 15, 19, 23, 29 and the handle 2 may be made using an automated die cutter, as described, generally, previously.

The support cut 40 of the present invention is approximately 1.5 inches long, but may be longer or shorter. Also, the support cut 40 is made approximately 0.5 inches from the bottom of the sleeve, but may be closer or further from the bottom of the sleeve 5, 9, 15, 19, 23, 29. As best seen in FIG. 16, the previously created support cut 40 of each of the sleeves 5, 9, 15, 19, 23, 29 allows the support segment 41 to be pushed inwards towards the center of the generally cylindrical sleeve 5, 9, 15, 19, 23, 29 during assembly. Thus, in this design, the inwardly pushed support segment 41 supports the bottom of the beverage container and prevents the container from sliding all the way through the sleeve 9. The support cut 40 and support segment 41 can also be incorporated into the previously discussed embodiment either in lieu of, or in addition to, the previously described tapered design of the sleeves 5, 9, 15, 19, 23, 29.

In an exemplary embodiment, the handle may be made of a different material from that used to form the individual sleeves. For example, the handle may be made of cardboard, while the individual sleeves are made of a different material, such as, but not limited to, foam rubber or neoprene. In another exemplary embodiment, the handle and sleeves can be formed from separate pieces of material assembled together to form a single carrier with multiple sleeves during the manufacturing process (as opposed to being cut from a single sheet of material as described above). In another exemplary embodiment, we speculate that the various contacts between the various portions of the carrier can be fixed via methods other than glue, including interlocking tabs, structured board (i.e., one-way insertion methods), hinges, tacks, staples, zippers, hook and loop tape (e.g., "Velcro"), sewn thread, springs, clips, buckles, hooks, magnets, nails, screws, suction or any similar attachment means know in the art.

It is understood that versions of the invention may come in different forms and embodiments. Additionally, it is understood that one of skill in the art would appreciate these various forms and embodiments as falling within the scope of the invention as disclosed herein.

We claim:

1. A beverage carrier for carrying one or more beverage containers, wherein said beverage carrier is entirely formed from a unitary piece of material, said carrier comprising:

a handle; and one or more sleeves, wherein each of said one or more sleeves is attached to said handle, and wherein each of said one or more sleeves is structured for being individually detached from said handle while each of said one or more sleeves remains structurally intact.

2. The beverage carrier of claim 1, wherein each of said one or more sleeves comprises a top end and a bottom end, where an upper diameter of said top end is greater than a lower diameter of said bottom end.

3. The beverage carrier of claim 2, wherein a beverage container is located within each of said one or more sleeves, respectively, wherein a lower void exists between a bottom of said beverage container and said bottom end of each of said one or more sleeves.

4. The beverage carrier of claim 1, wherein a beverage container is located within each of said one or more sleeves, respectively, wherein each of said one or more sleeves comprises a top end and a bottom end, and wherein a lower void exists between a bottom of said beverage container and said bottom end of each of said one or more sleeves.

5. The beverage carrier of claim 4, wherein each of said one or more sleeves further comprises a support segment for supporting a beverage container.

6. The beverage carrier of claim 1, wherein said handle comprises a first side and a second side, wherein the beverage carrier comprises four or more sleeves arranged in a first row and a second row, where said first row is disposed along a length of said first side of said handle and said second row is disposed along a length of said second side of said handle.

7. The beverage carrier of claim 1, wherein said beverage carrier comprises six sleeves.

8. The beverage carrier of claim 1, wherein said beverage carrier comprises four sleeves.

9. A beverage carrier for carrying one or more beverage containers, said carrier comprising:

a handle; and one or more sleeves, wherein each of said one or more sleeves defines a bottom and is attached to said handle along a perforated attachment surface, each respective perforated attachment surface configured in a generally vertical position along the exterior of each respective sleeve when the beverage carrier is in an upright position resting on the bottom of each respective sleeve, and wherein each of said one or more sleeves is configured for being individually detached from said handle via tearing of said perforated attachment surface, each of said one or more sleeves remaining structurally intact.

10. The beverage carrier of claim 9, wherein each of said one or more sleeves comprises a top end and a bottom end, where an upper diameter of said top end is greater than a lower diameter of said bottom end.

11. The beverage carrier of claim 10, wherein each of said one or more beverage containers is located within each of said one or more sleeves, respectively, wherein a lower void exists between a bottom of each of said beverage containers and said bottom end of each of said one or more sleeves.

12. The beverage carrier of claim 9, wherein a beverage container is located within each of said one or more sleeves, respectively, wherein each of said one or more sleeves comprises a top end and a bottom end, and wherein a lower void exists between a bottom of said beverage container and said bottom end of each of said one or more sleeves.

13. The beverage carrier of claim 12, wherein each of said one or more sleeves further comprises a support segment for supporting a beverage container.

14. The beverage carrier of claim 9, wherein said beverage carrier is formed from a unitary piece of material.

15. The beverage carrier of claim 9, wherein said handle comprises a first side and a second side, wherein the beverage carrier comprises four or more sleeves arranged in a first row and a second row, where said first row is disposed along a length of said first side of said handle and said second row is disposed along a length of said second side of said handle.

16. The beverage carrier of claim 9, wherein said beverage carrier comprises six sleeves.

17. The beverage carrier of claim 9, wherein said beverage carrier comprises four sleeves.

18. A method of assembling a beverage carrier, said method comprising the steps:

providing a unitary, substantially flat piece of material having a shape, said shape comprising:

a handle having two opposing edges; and at least one panel attached to each edge of said handle along an attachment surface, each panel having opposing ends;

making perforations along each attachment surface;

forming three-dimensional sleeves by attaching the opposing ends of each panel to each other each sleeve defining a bottom; and folding said handle in half such that each of the sleeves attached to one edge of the handle is aligned in a parallel configuration with a corresponding sleeve attached to the opposite edge of the handle, wherein each respective perforated attachment surface is configured in a generally vertical position along the exterior of each respective three-dimensional sleeve when the beverage carrier is in an upright position resting on the bottom of each respective sleeve.

19. The method of claim 18, wherein the opposing ends of each panel are attached to each other by adhesive applied to at least one of said opposing ends.

20. The method of claim 18, further comprising the step of creating at least one fold in each panel.

21. The method of claim 18, further comprising the steps of cutting a support cut in each panel to create a support segment for each sleeve and, after the step of forming each three-dimensional sleeve, pushing said support segment towards the center of each of said three-dimensional sleeves.

22. The method of claim 18, wherein said shape comprises three panels attached to each edge of said handle such that the assembled beverage carrier has three sleeves on each side of the folded handle.

23. The method of claim 18, wherein said shape comprises two panels attached to each edge of said handle such that the assembled beverage carrier has two sleeves on each side of the folded handle.

* * * * *